US005082125A

United States Patent [19]

Ninni

[11] Patent Number: 5,082,125

[45] Date of Patent: Jan. 21, 1992

[54] PARTITIONING DEVICE

[75] Inventor: David K. Ninni, Ravenna, Ohio

[73] Assignee: Wright Tool Company, Barberton, Ohio

[21] Appl. No.: 675,800

[22] Filed: Mar. 27, 1991

[51] Int. Cl.[5] ..... A47F 5/00

[52] U.S. Cl. ..... 211/184; 108/61

[58] Field of Search ..... 211/184, 181, 88, 106; 108/61

[56] References Cited

U.S. PATENT DOCUMENTS

| | | | |
|---|---|---|---|
| 691,628 | 1/1902 | Hoffman et al. . | |
| 2,954,878 | 10/1960 | Metzler et al. | 211/184 |
| 3,703,964 | 11/1972 | Field | 211/184 |
| 4,331,243 | 5/1982 | Doll | 211/184 X |
| 4,395,955 | 8/1983 | Pfeifer | 108/61 |
| 4,606,464 | 8/1986 | Jordan et al. | 211/184 X |
| 4,783,130 | 11/1988 | Twellmann | 312/193 |

FOREIGN PATENT DOCUMENTS 543832 3/1942 United Kingdom .

*Primary Examiner*—Blair M. Johnson

*Attorney, Agent, or Firm*—D. Peter Hochberg; Mark Kusner; Louis J. Weisz

[57] ABSTRACT

A display shelf for use in an article display unit having a bottom surface, side surfaces, a pair of support members disposed along the side surfaces and at least one partition for partitioning the display shelf into a plurality of compartments, each partition including a middle portion and two support arms attached to the middle portion. The support arms are dimensioned to releasably engage with the support members.

10 Claims, 2 Drawing Sheets

PARTITIONING DEVICE

BACKGROUND OF THE INVENTION

1. Field of the Invention

The present invention relates generally to an article display unit and more particularly to a partitioning device in a display shelf, for use in conjunction with the article display unit for partitioning the display shelves so as to segregate articles of differing characteristics, which partitioning devices may be quickly and easily attached to, removed from and shifted within the display shelf.

2. Description of the Prior Art

Display units are typically used for the purpose of displaying articles so that customers are induced to buy the articles on display. In case of articles like tools such as socket wrenches, it is important that the relative sizes of the wrenches be visually conveyed to customers, in order for them to be able to identify the exact size of the tools that they wish to purchase. Especially in case of tools whose sizes are close, it is difficult or nearly impossible for a customer to visually identify the exact size and type of tool that he/she wants if the tools are not separated. It is therefore important that different sized tools be divided clearly and separated from one another so that the customer can identify and choose the size or sizes that he/she wants.

A partitioning device is disclosed in U.S. Pat. No. 2,954,878 to Metzler et al. Metzler et al. discloses a sheet metal merchandise supporting base having a cylindrical protrusion on each of its longitudinal edges. Upstanding partitions are disclosed, the lower horizontal edge of each of which rests against the sheet metal base. The vertical edge of each partition has a flange, which on its lower end, has a hook which fits on the cylindrical protrusion on the longitudinal edges of the base. The partition is thus held on to the base. The hook, on only one side of each partition, is flexible with respect to the vertical edge of the partition to which it is connected. A problem with the disclosed device is that by providing only on flexible hook on each partition, the tendency would be for that one hook to be over-stressed by the repeated deflections involved in moving the partition and locking it at other locations, which could cause the hook to snap and break. Also, a fair amount of time would be necessary to lock each partition.

U.S. Pat. No. 3,703,964 to Field discloses a shelf divider formed of a resilient material having clamping means on each side thereof for engagement with a shelf. Each divider has an integrally formed U-shaped section on its base, so as to resiliently spread the longitudinal extent of the base by applying tension thereto. Once the clamping members have been fitted over the base, a collar member may be fitted over the U-shaped portion so as to tighten the divider onto the base. This invention would require a significant amount of time in fitting each divider on to the base of a shelf. The process of attaching each divider involves several separate steps and would be extremely time consuming which time can be ill-afforded in applications wherein a plurality of such dividers are needed. Additionally, it would not be possible for such a divider to be moved along the base of a divider once the collar member has been fitted over the U-shaped section. Also, it is felt that the divider would not be rigid enough, i.e., would be very loosely attached to the base if the collar member were not used. Moreover, the divider's construction is fairly intricate and involves a number of separate components, which would serve to make such a divider fairly expensive.

The device of the present invention overcomes these and other problems by providing a relatively inexpensive and easy to fabricate display shelf and partitioning devices, which partitioning devices may be quickly and easily attached to be removed from and shifted within the display shelf, each partitioning device having two flexibly attached locking members dimensioned to be releasably locked with the display shelf.

SUMMARY OF THE INVENTION

In accordance with the preferred embodiment of the present invention, there is provided one or more display shelves having partioning devices for attachment thereto, the shelves forming part of a display unit for the display of articles. The partitioning devices are used for the purpose of partitioning the shelf so that articles having different characteristics may be placed in the different compartments created by the dividers. Each shelf has a rectangular bottom surface and rectangular side walls attached to each side of the bottom. Disposed along the side walls, attached thereto or integral therewith are support members dimensioned to releasably engage with the partitioning devices. The support members preferably comprise two identical elongated cylindrical rods which are parallel to each other. Each partitioning device includes a middle body portion, on either side of which and attached thereto are locking means in the form of two identical arms. One end of each of the arms is connected with the base of the middle portion. The arms are flexible with respect to the middle portion. Each arm has as its free end a locking member dimensioned to releasably engage with the support members on the shelf.

The locking members preferably comprise an annular semi-cylinder with the "open" inside surface of the annular semi-cylinder facing away from the middle portion of the partitioning device. The length of the middle portion of the partitioning device is dimensioned so that when the locking member on one of the arms is releasably engaged with one of the support members on the shelf, the other arm has to be urged towards the middle portion of the partitioning device in order for the locking members on the latter arm to be positioned to releasably engage with the support members on the shelf.

An object of the present invention is to provide a partitioning device capable of quick and easy installation on a display shelf for the purpose of compartmentalizing the shelf which typically forms a part of an article display unit.

Another object of the present invention is to provide a partitioning device, having a sturdy construction, capable of withstanding frequent removal from, attachment to and movement within the shelf.

Yet another object of the present invention is to divide and lessen the effect of the stresses on the partitioning device, associated with frequent removal from, attachment to and movement within the shelf, by providing one flexible arm on either side of the partitioning device.

A further object of the present invention is to provide a partitioning device, which may be moved with relative ease within the display shelf so as to create larger or smaller compartments.

Yet another object of the present invention is to provide a partitioning device, which is dimensioned to releasably engage with a support member within a display shelf.

A still further object of the present invention is to provide a partitioning device which may be used to form a plurality of compartments in a display shelf, so as to enhance the aesthetic appeal of the display shelf.

Another object of the present invention is to provide a display shelf with a plurality of compartments so as to aid customers in distinguishing between visually indistinguishable items by placing them in separate compartments.

Yet another object of the present invention is to provide a display shelf, having a simple construction and which is inexpensive and easy to manufacture.

A further object of the present invention is to provide a partitioning device, which is inexpensive and easy to manufacture.

A still further object of the present invention is to provide a display shelf having a plurality of partitioning devices for creating a plurality of compartments for segregating tools such as socket wrenches of varying sizes, the display shelf having markings coinciding with the location of the compartments to further aid customers in identifying the tool of their choice.

These and other objects and advantages will become apparent from the following description of the preferred embodiment taken together with the accompanying drawings.

BRIEF DESCRIPTION OF THE DRAWINGS

The present invention may take physical form in certain parts and arrangements of parts, a preferred embodiment of which will be described in detail in this specification and illustrated in the accompanying drawings which form a part hereto and wherein.

DETAILED DESCRIPTION OF THE PREFERRED EMBODIMENT

Figure 1:
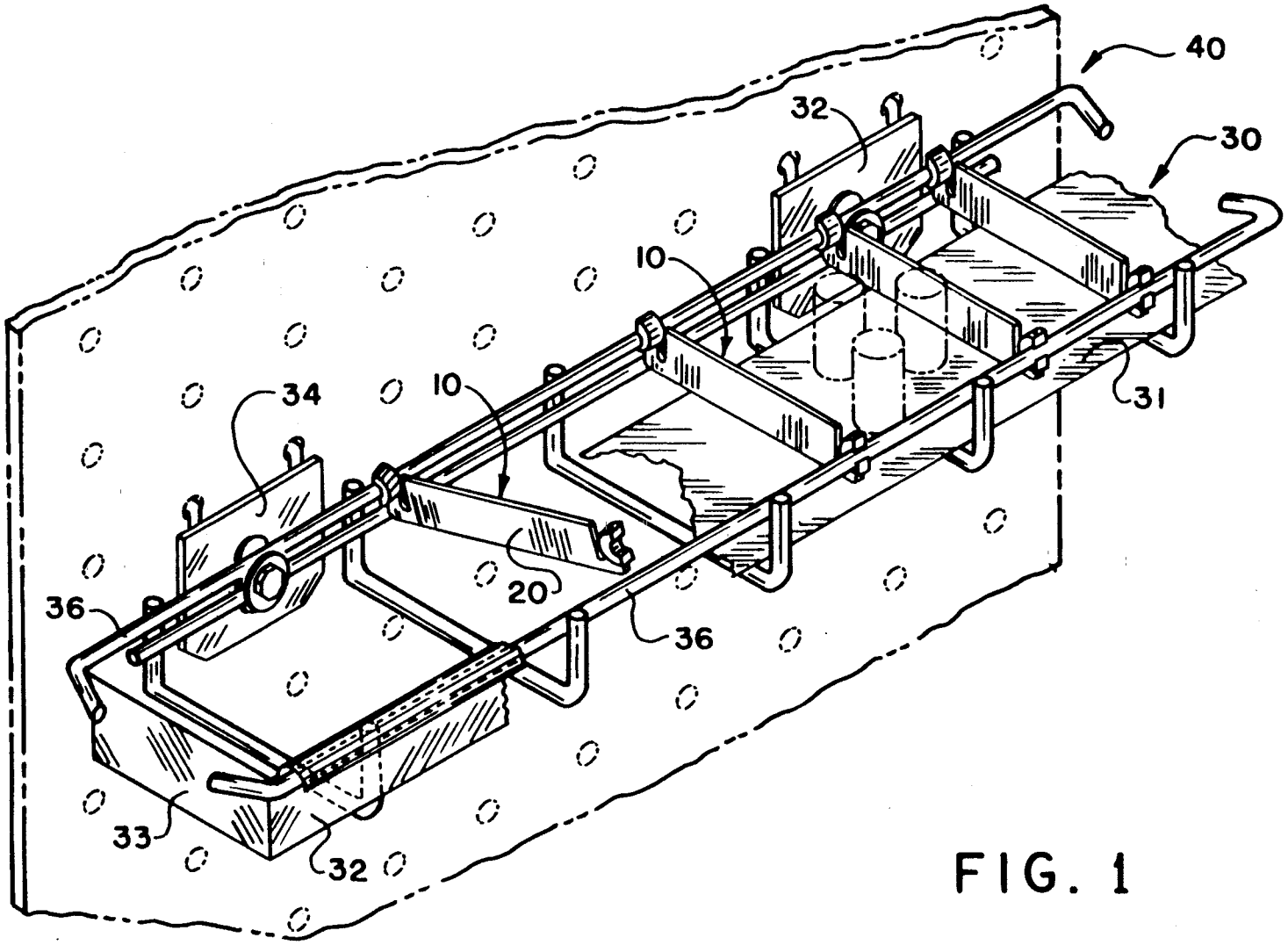
FIG. 1 is an elevational view showing a plurality of partitioning device in positions of partial and complete attachment to a display shelf which forms a part of an article display unit.
Figure 2:
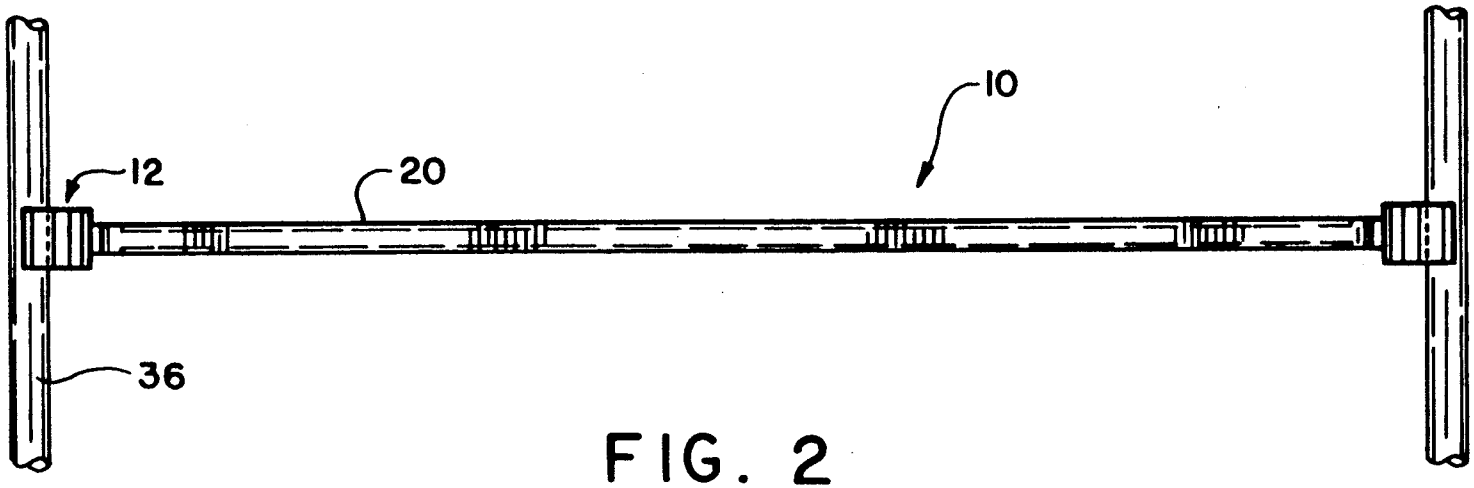
FIG. 2 is an elevational view of a partitioning device of FIG. 1.

Referring now to the drawings wherein the showings are for the purpose of illustrating the preferred embodiment of the invention only and not for the purpose of limiting the same, FIG. 1 illustrates a plurality of partitioning devices or dividers 10 according to the preferred embodiment of the present invention, in varying positions of partial and complete attachment to a display shelf 30 which forms part of an article display unit 40. Display unit 40 in and of itself does not form a part of the present invention, and is described for the purpose of illustrating application of the present invention, it being understood that the present invention finds advantageous application in other types of display units and wherever display shelves of the nature provided by the present invention are desired. In the preferred embodiment, display shelf 30 has a rectangular bottom surface 31, and four rectangular side walls 32, 33 and 34 (the wall opposite wall 33 has been omitted for clarity), each attached at one end to bottom surface 31. Display shelf 30 includes two elongated cylindrical rods 36, which have the same diameter, and are parallel to each other, each rod being attached adjacent to one of the longer pair of side walls 32 and 34 of the shelf 30. The length of the rods 36 is slightly more than the length of the side walls 32 and 34.

Figure 3:
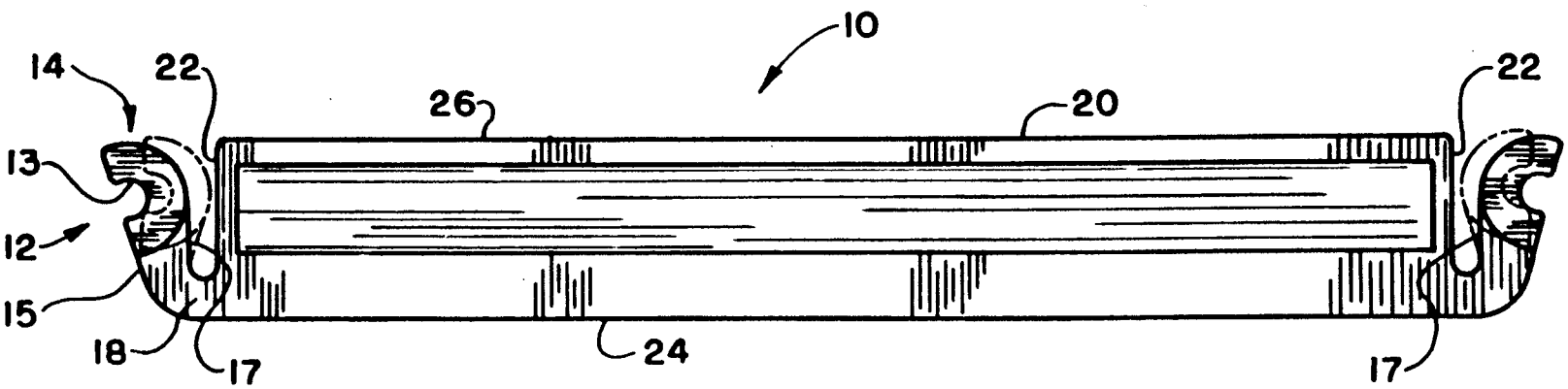
FIG. 3 is a close-up elevational view of one end of the partitioning device of FIG. 1, the end being attached to a display shelf which forms part of the article display unit.

According to the present invention, as best seen in FIG. 3, each partitioning device 10 is comprised of a generally flat middle portion 20, integral with which and located on either side of which, are two identical snap arms 12. It will be understood that snap arms 12 are identical in all respects to each other. In the preferred embodiment shown, the flat middle portion 20 is generally rectangular in shape having two parallel edges 22 as its smaller sides and two parallel edges 24 and 26 as its longer sides. Snap arm 12 is flexible with respect to the flat middle portion 20, capable of being urged towards flat middle portion 20 until inner surface 17 of snap arm 12 is in contact with surface 22 of the flat middle portion 20. In its normal installed position, surface 17 of snap arm 12 is generally adjacent and parallel to surface 22. Surface 22 and surface 17 are dimensioned so that when the divider 10 is in position in the display shelf 30, edge 24 of the middle portion 20 is in close proximity with the bottom 31 of display shelf 30. One end of snap arm 12 is attached to the flat middle portion 20 by connecting portion 18. Snap arm 12 has on its opposite, free end, an integrally formed annular semi-cylindrical structure which is generally designated as 14, with the "open" inside surface 13 of the annular semi-cylinder 14, facing away from the flat middle portion 20. In the preferred embodiment shown, inside surface 13 of the annular semi-cylinder 14 forms the arc of a circle having a diameter roughly equal to the diameter of the two elongated cylindrical rods 36. As can be best seen in FIG. 3, surface 15 of snap arm 12 is inclined with respect to edge 24 of middle portion 20 at the same angle as the inclination of the ends of the annular semi-cylinder 14 with respect to edge 24 of the middle portion 20.

The display shelf 30 and the rods 36 are typically constructed of a metal such as steel. The display unit of which the display shelf and the partitioning devices are components, is of the type typically referred to as a "wire rack". The partitioning device 10 is typically constructed of an engineering plastic which is capable of sustaining high loads and stresses and which is dimensionally stable. Some plastics which satisfy the above criteria are: nylons, acetals, polycarbonates, acrylonitrile-butadiene-styrene copolymers, polypropylene and polyphenylene oxide/styrene copolymers.

Referring now to the operation of the present invention, there is provided a display shelf 30 having a pair of cylindrical rods 36 dimensioned to releasably and lockingly receive one or more partitioning devices 10, the partitioning devices 10 being capable of quick and easy installation in, removal from and movement within display shelf 30. One or more display shelves 30 may be attached to an article display unit. The annular semi-cylindrical structure 14 on one of the snap arms 12 of a partitioning devices 10 is pressed and locked onto one of the identical cylindrical rods 36 of a display shelf 30 so that the "open" inside surface 13 of the annular semi-cylinder 14 is in sliding engagement with and releasably locked on the surface of the cylindrical rod. It is important to note that in this position, the partitioning device 10 is freely movable around the cylindrical rod 36. The free end of the partitioning device 10 with the annular semi-cylinder 14 on its snap arm 12 is then pivoted towards the other cylindrical rod 36 and pressed into locking position by pushing down on the partitioning device 10 so that snap arm 12 is urged towards flat portion 20 before lockingly engaging with the other rod 36. Importantly, the partitioning device 10 is parallel to the wall 33 of display shelf 30 and in close proximity with bottom surface 31. Additionally, the partitioning device 10 may be moved relatively easily on the two rods 36, i.e., to different positions thereby creating smaller and larger compartments. A plurality of partitioning devices 10 may be similarly attached to display shelf 30 thereby creating more compartments.

Thus it can be seen that the present invention provides a display shelf, one or more of which may be used as part of an article display unit, having a pair of cylindrical rods therein, onto which may be attached one or more partitioning devices, to create compartments which enhance the aesthetic appeal of the display unit and also provide a fast and effective way of segregating visually indistiguishable articles. Furthermore, the partitioning devices are dimensioned so that they may be removed from the display shelves without any intricate maneuvering. Additionally, the partitioning devices are constructed of material capable of withstanding the stresses associated with repeated attachment to, removal from and movement within the display shelf. Partitioning devices made from many plastics can carry the name of the products to be carried in the display shelves.

The present invention has been described with respect to a preferred embodiment. Modifications and alterations will occur to others upon the reading and understanding of the specification. In this respect, the display shelves may be formed with a pair of cylindrical depressions in the same, the arms of the partitioning devices having thereon solid cylinders dimensioned to releasably engage with the cylindrical depressions in the display shelf. It is intended that all such modifications and alterations be included insofar as they come within the scope of the invention as claimed or equivalents thereof.

What is claimed is:

1. A partitioning device for use with, and detachably connectable to a display shelf having a pair of parallel elongated support means, said partitioning device comprising:

a substantially planar middle body portion having a top edge 1*a* bottom edge and a pair of opposing ends; and a pair of substantially identical flexible locking means having first and second ends thereto, the first end of each of said locking means being connected to a respective end of said body portion adjacent said bottom edge the second end of each of said locking means extending upwardly from said first end toward said top edge and having an annular locking member with an open surface, said open surface of each said locking members facing away from said body portion and being dimensioned to be releasably locked onto and in slidable engagement with one of said support means of said display shelf.

2. A partitioning device as in claim 1 wherein said locking means of said partitioning device are identical to each other.

3. The invention of claim 1 wherein said middle body portion has a lower section, and said locking means are flexible support arms with their first ends connected to the lower section of one end of said middle portion and their second ends are spaced from the middle body portion beyond the spacing of the pair of support means, said locking members being flexed toward the body portion to install said partitioning device on said support means and being biassed toward said support means to releasably lock said locking members on the support means.

4. The invention according to claim 3 wherein said second ends of said locking means are semi-cylindrical, and dimensioned to be releasably locked onto and in slidable engagement with said support means.

5. A partitioning device as in claim 4 wherein said partitioning device is constructed of an engineering plastic.

6. A partitioning device according to claim 5 wherein said engineering plastic is polypropylene.

7. In an article display unit, having one or more display shelves, each said shelf having a pair of opposing side walls, the improvement comprising:

a pair of parallel, elongated support means attached to and extending between said opposing side walls of each said display shelf; and at least one partitioning device for partitioning said display shelf into a plurality of compartments, each said partitioning device being detachably connectable to said shelf and comprising a middle body portion having a pair of opposing ends, and a pair of substantially identical flexible locking means having first and second ends thereto, the first end of each said locking means being connected to one end of said body portion, said second end of each of said locking means having an annular locking member with an open surface, said open surface of each said locking member facing away from said body portion and being dimensioned to be releasably locked onto and in slidable engagement with one said support means of said display shelf, and said locking means being biassed to urge said open surfaces against said support means.

8. The improvement of claim 7 wherein said locking means of each said partitioning device are identical to each other.

9. The improvement of claim 7 wherein said support means are cylindrical and said locking members are semi-cylindrical, said open surfaces being generally C-shaped and dimensioned to be releasably locked onto and in a slidable engagement with each said support means.

10. The improvement of claim 7 wherein said partitioning device is constructed of an engineering plastic.

* * * * *